US010564580B2

(12) United States Patent
Miyake

(10) Patent No.: US 10,564,580 B2
(45) Date of Patent: Feb. 18, 2020

(54) FIXING DEVICE AND IMAGE FORMING APPARATUS

(71) Applicant: KYOCERA Document Solutions Inc., Osaka (JP)

(72) Inventor: Takashi Miyake, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/928,156

(22) Filed: Mar. 22, 2018

(65) Prior Publication Data

US 2018/0292772 A1 Oct. 11, 2018

(30) Foreign Application Priority Data

Apr. 11, 2017 (JP) ..... 2017-078271

(51) Int. Cl.
*G03G 15/20* (2006.01)

(52) U.S. Cl.
CPC ..... *G03G 15/206* (2013.01); *G03G 15/2053* (2013.01)

(58) Field of Classification Search
CPC ..... G03G 15/2053
See application file for complete search history.

(56) References Cited

U.S. PATENT DOCUMENTS 8,571,456 B2 10/2013 Samei et al.
2008/0286018 A1* 11/2008 Lee ..... G03G 15/2053 399/329
2009/0123202 A1* 5/2009 Yoshinaga ..... G03G 15/2032 399/329
2010/0092221 A1* 4/2010 Shinshi ..... G03G 15/2039 399/330
2011/0026988 A1 2/2011 Yoshikawa et al.
2011/0229226 A1* 9/2011 Tokuda ..... G03G 15/2039 399/329

FOREIGN PATENT DOCUMENTS

JP 2012-123272 A 6/2012

OTHER PUBLICATIONS

The extended European search report issued by the European Patent Office dated Aug. 14, 2018, which corresponds to European Patent Application No. 18157632.3-1022 and is related to U.S. Appl. No. 15/928,156.

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A fixing device includes a flexible rotating fixing belt, a pressing member, a heating part, a guide member and a contact force changing part. The pressing member forms a pressing area with the fixing belt. The heating part heats the fixing belt from an outside of the fixing belt. The guide member comes into contact with an inner circumferential face of the fixing belt to support the fixing belt so as to face the heating part. The contact force changing part moves the guide member in directions close to or away from the fixing belt to change a contact force between the guide member and the fixing belt depending on a pressure of the pressing area.

7 Claims, 4 Drawing Sheets

FIXING DEVICE AND IMAGE FORMING APPARATUS

INCORPORATION BY REFERENCE

This application is based on and claims the benefit of priority from Japanese Patent application No. 2017-078271 filed on Apr. 11, 2017, which is incorporated by reference in its entirety.

BACKGROUND

The present disclosure relates to a fixing device fixing a toner image on a sheet and an image forming apparatus including the fixing device.

In response to a request for saving energy and shortening a warm-up time, a fixing device having a small heat capacity is developed. For a fixing device having a small heat capacity, a flexible fixing belt to be electromagnetically heated by an exciting coil is sometimes used. A pressing member is pressed against the fixing belt to form a pressing area between the pressing member and the fixing belt. When the pressing member is rotated, the fixing belt is driven to be rotated, and a sheet passes through the pressing area. At this time, a toner image transferred on the sheet is heated and pressed to be fixed on the sheet. Inside the fixing belt, a belt guide is disposed so as to face the exciting coil at a position opposing to the pressing area. The belt guide comes into contact with an inner circumferential face of the fixing belt to support the fixing belt. Such a belt guide makes it possible to reduce the heat capacity of the fixing belt.

In such a fixing device, when the fixing belt is rotated, the pressing member and the belt guide are slid with respect to the fixing belt. If sliding load of the pressing member and the belt guide is large, the fixing belt may be slipped to cause heating failure and conveying failure.

Especially, if a pressure of the pressing area is changeable, when the pressure is lowered, since a driving force of the fixing belt is lowered, these failure are easily occurred.

The fixing device is sometimes provided with a separating mechanism in which a heating member (the belt guide) disposed to come into contact with the inner circumferential face of the fixing belt is separated with respect to the fixing belt. By separating the heating member from the fixing belt, a heating condition of the heating belt can be finely adjusted.

However, if the heating member is separated from the fixing belt, a rotating orbit of the fixing belt becomes unstable or changes. Then, a distance between the exciting coil and the fixing belt is changed, and then a heating efficiency of the fixing belt may be lowered or a conveying failure may be occurred at an inlet for the pressing area.

SUMMARY

In accordance with an aspect of the present disclosure, a fixing device includes a flexible rotating fixing belt, a pressing member, a heating part, a guide member and a contact force changing part. The pressing member forms a pressing area with the fixing belt. The heating part heats the fixing belt from an outside of the fixing belt. The guide member comes into contact with an inner circumferential face of the fixing belt to support the fixing belt so as to face the heating part. The contact force changing part moves the guide member in directions close to or away from the fixing belt to change a contact force between the guide member and the fixing belt depending on a pressure of the pressing area.

In accordance with an aspect of the present disclosure, an image forming apparatus includes an image forming part and the above fixing device. The image forming part forms a toner image on a sheet. The fixing device fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a fixing device according to one embodiment of the present disclosure will be described.

Figure 1:
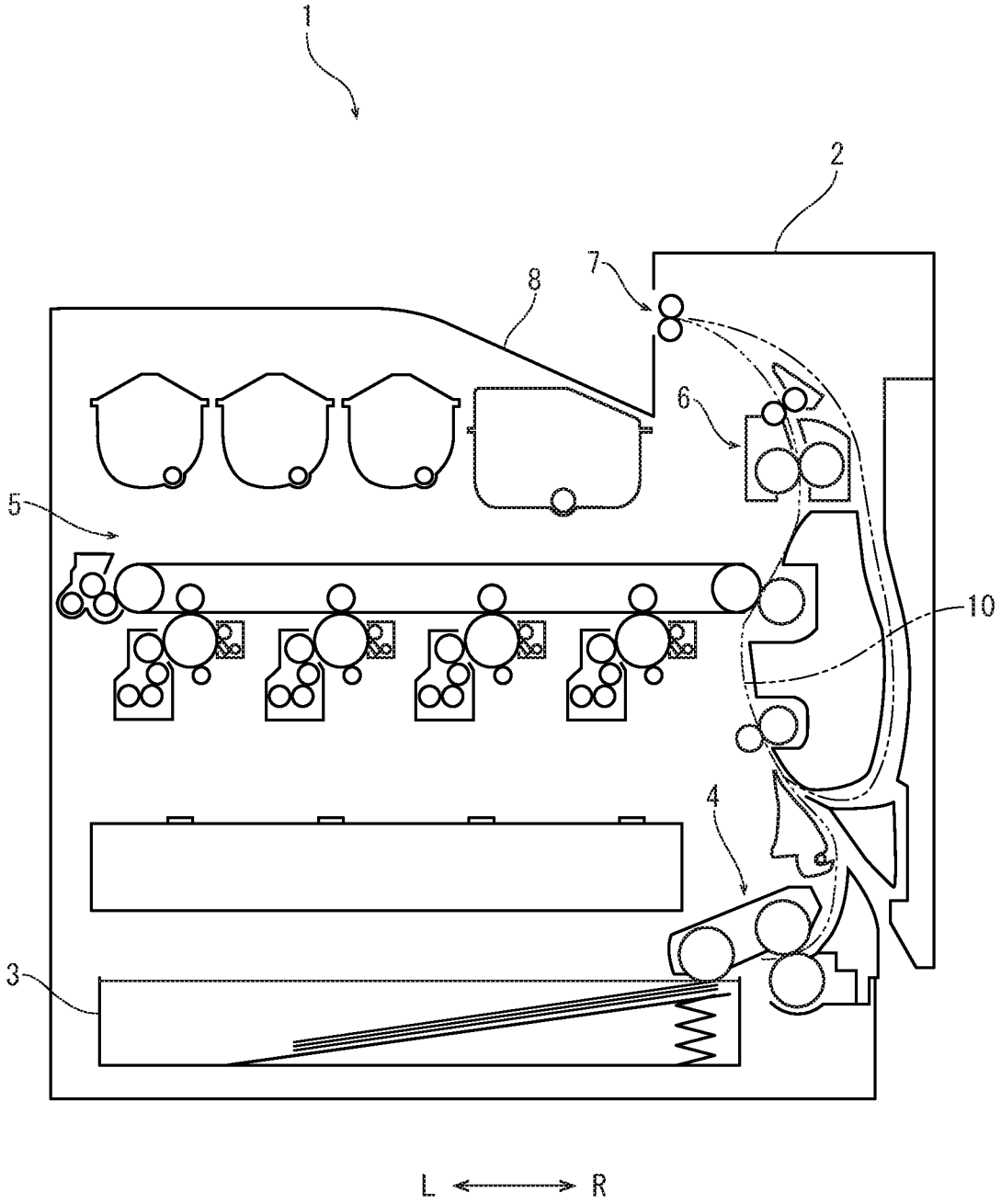
FIG. 1 is a front view schematically showing an inner structure of a printer according to one embodiment of the present disclosure.

With reference to FIG. 1, an entire structure of a color printer 1 as an image forming apparatus will be described. FIG. 1 is a font view schematically showing an inner structure of the color printer 1. In the following description, a near side (a front side) of a paper plan of FIG. 1 is decided to be a front side of the color printer 1. In each figure, L and R respectively indicate a left side and a right side.

An apparatus main body 2 of the color printer 1 is provided with a sheet feeding cassette 3 storing a sheet S, a sheet feeding device 4 feeding the sheet S from the sheet feeding cassette 3, an image forming part 5 forming a toner image on the sheet S, a fixing device 6 fixing the toner image on the sheet S, an ejecting device 7 ejecting the sheet S and an ejected sheet tray 8 on which the ejected sheet S is stacked. In the apparatus main body 2, a conveying path 10 for the sheet S is formed so as to extend from the sheet feeding device 4 to the ejecting device 7 through the image forming part 5 and the fixing device 6.

The sheet S is fed by the sheet feeding device 4 from the sheet feeding cassette 3, and conveyed along the conveying path 10 to the image forming part 5. At the image forming part 5, the toner image is formed on the sheet S. The sheet S is conveyed along the conveying path 10 to the fixing device 6. The fixing device 6 fixes the toner image on the sheet S. The sheet S on which the toner image is fixed is ejected from the ejecting device 7, and then stacked on the ejected sheet tray 8.

Figure 2:
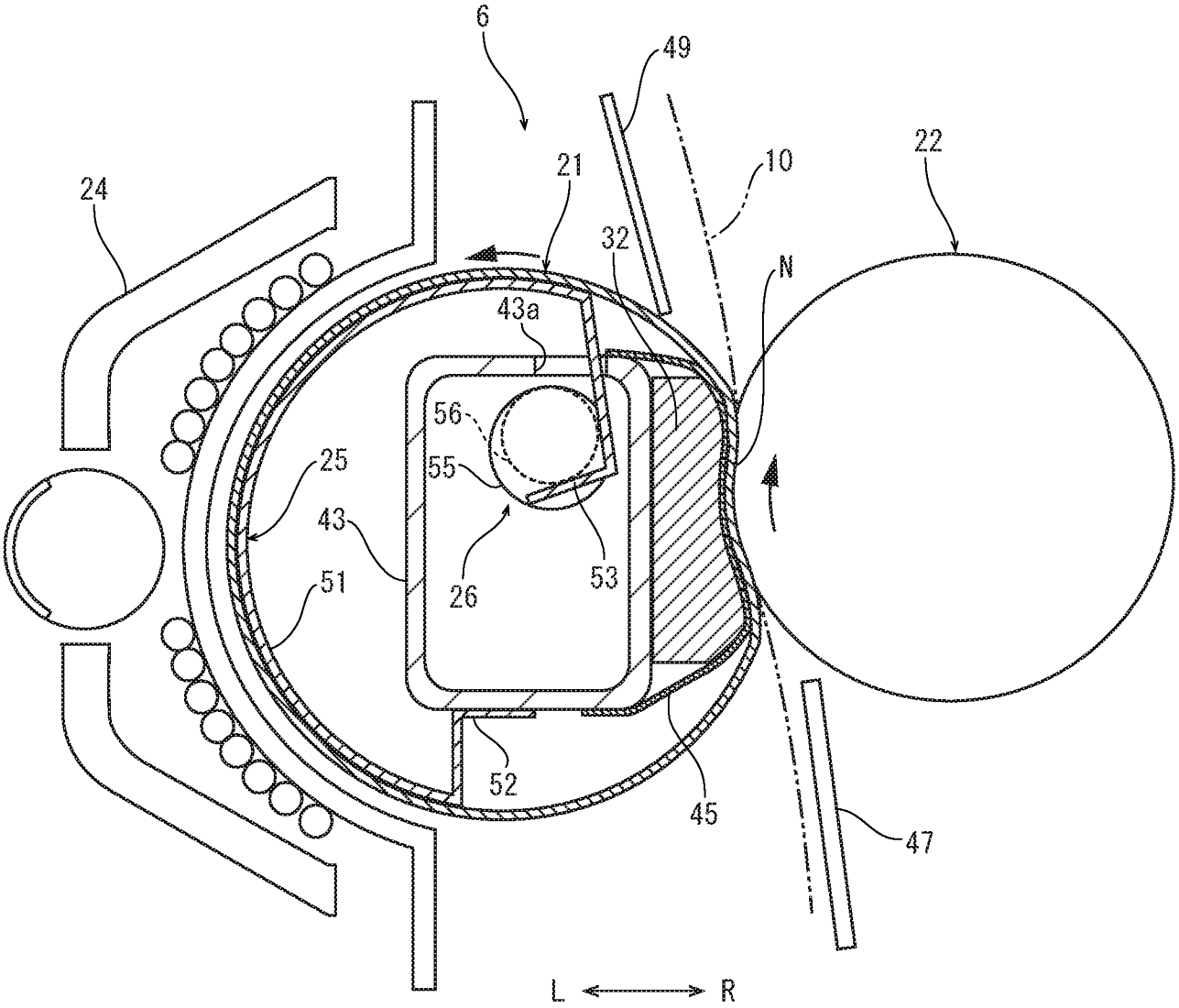
FIG. 2 is a sectional view showing a fixing device, in a state where a belt guide contacts a fixing belt with high pressure, according to the embodiment of the present disclosure.
Figure 3:
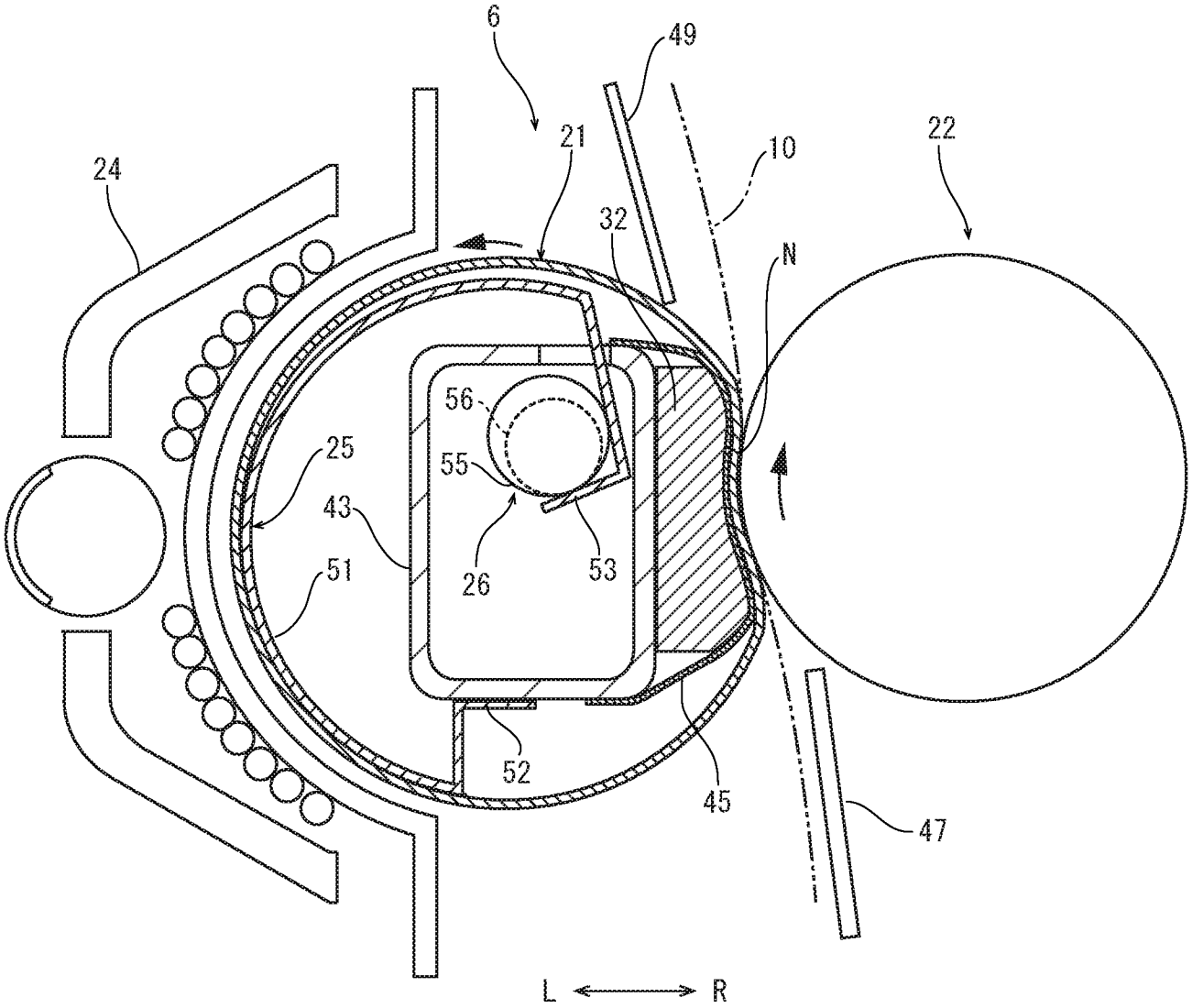
FIG. 3 is a sectional view showing the fixing device, in a state where the belt guide contacts the fixing belt with low pressure, according to the embodiment of the present disclosure.
Figure 4:
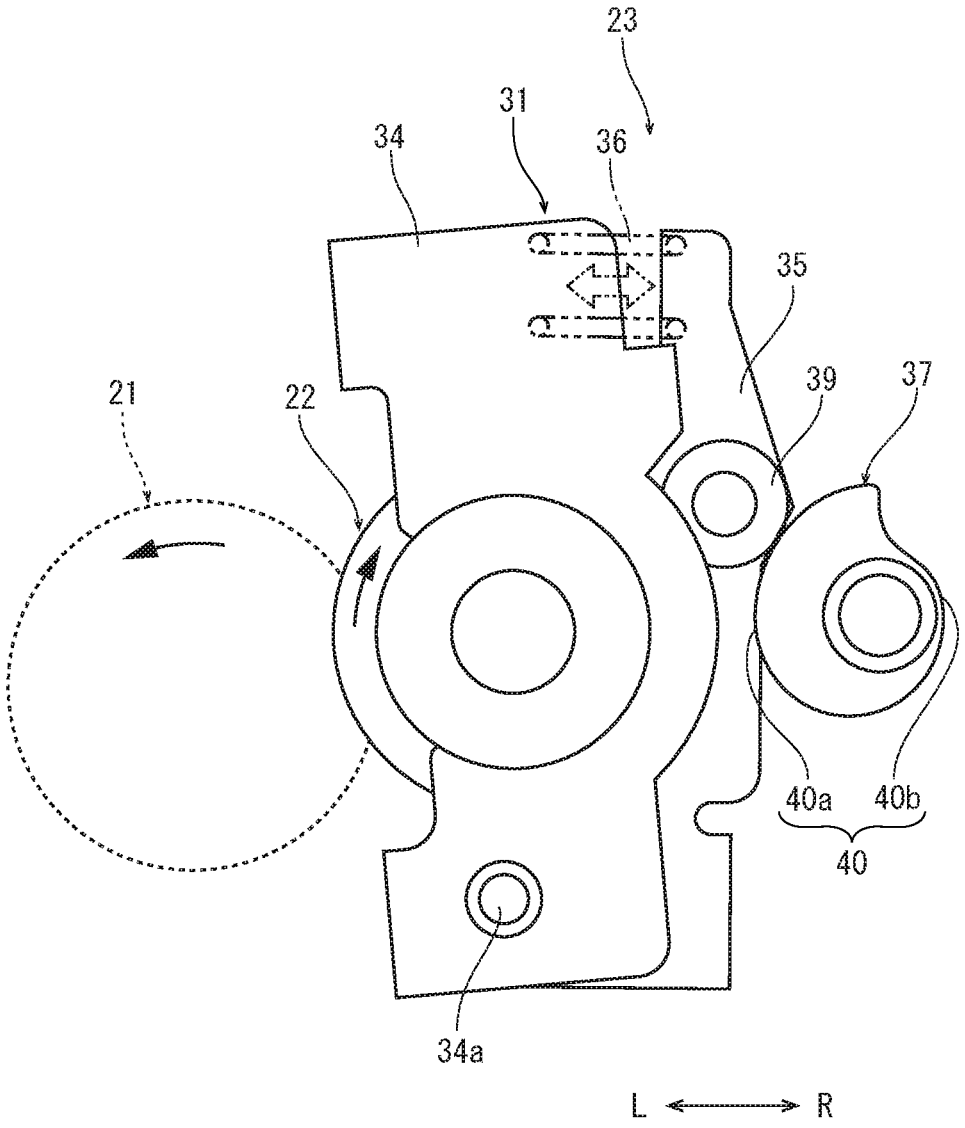
FIG. 4 is a side view showing a pressure changing part of the fixing device according to the embodiment of the present disclosure.

With reference to FIG. 2 to FIG. 4, the fixing device 6 will be described. FIG. 2 is a sectional view showing the fixing device in a state where a belt guide contacts a fixing belt with high pressure, FIG. 3 is a sectional view showing the fixing device in a state where the belt guide contacts the fixing belt with low pressure, and FIG. 4 is a side view showing a pressure changing part of the fixing device.

As shown in FIG. 2 and FIG. 3, the fixing device 6 includes a flexible endless fixing belt 21, a pressing roller 22 as a pressing member forming a pressing area N with the fixing belt 21, a pressure changing part 23 (refer to FIG. 4) changing a pressure of the pressing area N, an induction heating (IH) heater 24 as a heating part heating the fixing belt 21, a belt guide 25 as a guide member contacting an inner circumferential face of the fixing belt 21 and supporting the fixing belt 21 so as to face the IH heater 24 and a contact force changing part 26 changing contact force between the belt guide 25 and the fixing belt 21.

The fixing belt 21 is an endless belt having a predetermined inner diameter and a width longer than a width of a sheet passing area through which the sheet is passed. The fixing belt 21 has the inner diameter of 20 mm to 50 mm, for example. The fixing belt 21 is made of flexible material, and has a base layer, an elastic layer provided around the base layer and a release layer provided around the elastic layer. The base layer is made of magnetic metal such as Ni or polyimide resin added with metal such as Cu, Ag and Al. When the fixing belt 21 is made of Ni, the fixing belt 21 has a thickness of 25 μm to 50 μm, for example. When the fixing belt 21 is made of polyimide resin, the fixing belt 21 has a thickness of 50 μm to 100 μm, for example. The elastic layer is made of silicon rubber, for example. The elastic layer has a thickness of 100 μm to 500 μm, for example. The release layer is made of PFA tube, for example. The release layer has a thickness of 15 μm to 50 μm, for example. A sliding layer may be formed around an inner circumferential face of the base layer. The sliding layer is made of polyimide-amide or PTFE.

The both ends of the fixing belt 21 are supported by a supporting mechanism (not shown), and the fixing belt 21 is rotatable around a rotation axis.

The pressing roller 22 includes a core metal, an elastic layer provided around the core metal and a release layer provided around the elastic layer. The elastic layer is made of silicon rubber, and the release layer is made of PFA tube, for example.

The pressing roller 22 is disposed at the right side of the fixing belt 21, and supported by the pressure changing part 23 so as to turn in directions close to or away from the fixing belt 21. One end of the core metal is connected to a drive source (not shown). The pressing roller 22 is driven by the drive source to be rotatable in the clockwise direction in FIG. 2 and FIG. 3.

As shown in FIG. 4, the pressure changing part 23 includes a pressing roller supporting part 31 and a pressing pad 32 (refer to FIG. 2 and FIG. 3). The pressing roller supporting part 31 supports the pressing roller 22 so as to be turnable. The pressing pad 32 is disposed inside the fixing belt 21 so as to face the pressing roller 22.

With reference to FIG. 4, the pressing roller supporting part 31 will be described. The pressing roller supporting part 31 includes a supporting arm 34 supporting the pressing roller 22 so as to be rotatable, a pressing arm 35 turnably connected to the supporting arm 34, a spring 36 disposed between the supporting arm 34 and the pressing arm 35 and an eccentric cam 37 capable of coming into contact with the pressing arm 35.

The supporting arm 34 rotatably supports each of both ends of the core metal of the pressing roller 22. Each supporting arm 34 is turnable around a rotating shaft 34*a*. The pressing arm 35 is disposed at an opposite side to the fixing belt 21 with respect to each supporting arm 34. The pressing arm 35 is turnable around the rotating shaft 34*a* of the supporting arm 34. Each pressing arm 35 has a cam follower 39 at the opposite face to the fixing belt 21.

The spring 36 is disposed between each supporting arm 34 and each pressing arm 35, and biases each pressing arm 35 in a direction away from the supporting arm 34.

The eccentric cam 37 has a cam face 40 around its outer circumferential face. The cam face 40 is formed such that a distance between the outer circumferential face and a rotation axis is varied along the circumferential direction, and has a pressure increasing face 40*a* having the largest distance and a pressure decreasing face 40*b* having the smallest distance. Against the cam face 40 of the eccentric cam 37, the cam follower 39 of the pressing arm 35 is pressed by biasing force of the spring 36.

As shown in FIG. 2 and FIG. 3, the pressing pad 32 is supported by a supporting member 43 disposed inside the fixing belt 21. The supporting member 43 is formed into a hollow rectangular cylindrical shape. The pressing pad 32 is disposed so as to face the pressing roller 22 and contacts the inner circumferential face of the fixing belt 21. The pressing pad 32 is made of liquid crystal polymer, for example. An elastomer layer may be formed on the contact face of the pressing pad 32 with the inner circumferential face of the fixing belt 21. An outer circumferential face of the pressing pad 32 is covered with a sliding sheet 45. The sliding sheet 45 is made of low-frictional resin having low heat generation property, such as fluororesin, for example.

As described above, the pressing roller 22 is pressed against the fixing belt 21 by the pressure changing part 23, and the pressing area N is formed between the pressing roller 22 and the fixing belt 21 along the conveying path 10. At an upstream side of the pressing area N in the conveying direction, an introducing guide 47 guiding the sheet to the pressing area N is provided, and at a downstream side of the pressing area N in the conveying direction, a separating plate 49 separating the sheet from the fixing belt 21 is provided.

An operation to change the pressure of the pressing area N by the pressure changing part 23 will be described. When the eccentric cam 37 is driven by a motor (not shown) to be rotated, the cam follower 39 follows the cam face 40 of the eccentric cam 37, and the pressing arm 35 is turned around the rotating shaft 34*a*. When the pressure increasing face 40*a* of the eccentric cam 37 comes into contact with the cam follower 39, the pressing arm 35 turns close to the supporting arm 34, and the supporting arm 34 is turned in the direction close to the fixing belt 21. Thereby, the pressing roller 22 is pressed against the pressing pad 32 via the fixing belt 21 and the sliding sheet 45 to increase the pressure of the pressing area N. On the other hand, when the pressure decreasing face 40*b* of the eccentric cam 37 comes into contact with the cam follower 39, the pressing arm 35 turns away from the supporting arm 34, and the supporting arm 34 is turned in the direction away from the fixing belt 21. Thereby, the pressure of the pressing area N is decreased. In the above manner, the pressure of the pressing area N is increased or decreased. For example, the decreased pressure of the pressing area N is about 1/10 of the increased pressure.

The IH heater 24 includes a coil part, a coil bobbin supporting the coil part spirally and an arch core. The IH heater 24 is supported so as to cover a left half of the outer circumferential face of the fixing belt 21. When the coli part is applied with a high-frequency alternative voltage to generate magnetic field, the magnetic field generates eddy current in the base layer of the fixing belt 21 to heat the base layer and then to heat the fixing belt 21.

The belt guide 25 is an elastic member, and has a main part 51 coming into contact with the inner circumferential face of the fixing belt 21, a supporting end part 52 provided at one end (an upper end) of the main part 51 in the circumferential direction of the fixing belt 21, and a cam engaging end part 53 provided at the other end (a lower end) of the main part 51. The belt guide 25 is made of electric conductive material, and has a thickness of 0.1 mm to 0.5 mm, for example.

The main part 51 has an arc-shaped cross section along the inner circumferential face of the fixing belt 21. The supporting end part 52 is formed in such a manner that the lower end of the main part 51 is bent inward in a radial direction of the fixing belt 21 and then bent in an opposite direction to the main part 51 at right angles. The supporting end part 52 is fixed to a lower face of the supporting member 43. The cam engaging end part 53 is formed in such a manner that the upper end of the main part 51 is bent inward in the radial direction of the fixing belt 21 and then bent toward the main part 51 at an angle slightly larger than a right angle. The cam engaging end part 53 passes through an opening 43*a* of the supporting member 43, and enters the hollow space of the supporting member 43.

The belt guide 25 is supported by the supporting member 43 so as to apply tension in the counterclockwise direction in FIG. 2 and FIG. 3 around the supporting end part 52. Thereby, the inner circumferential face of the fixing belt 21 is applied with the outward tension in the radial direction so that a rotating orbit of the fixing belt 21 is stabilized. In addition, because the magnetic field penetrating through the fixing belt 21 is absorbed by the belt guide 25 to heat the belt guide 25, the heating efficiency can be increased.

The contact force changing part 26 includes a rotating shaft 55 disposed in the hollow space of the supporting member 43 in parallel with the rotation axis of the fixing belt 21. A center portion of the rotating shaft 55 is partially cut along the circumferential direction so as to have a small diameter. The cut portion of the rotating shaft 55 forms an eccentric cam 56. With the eccentric cam 56, the cam engaging end part 53 of the belt guide 25 is engaged from the lower side. In a state where the rotating shaft 55 is rotated such that the cam engaging end part 53 is engaged with the eccentric cam 56 as shown in FIG. 2, the belt guide 25 is kept in a contact posture where the main part 51 forcefully contacts the inner circumferential face of the fixing belt 21 by the elastic force in the counterclockwise direction in FIG. 2 and FIG. 3. On the other hand, in a state where the rotating shaft 55 is rotated such that the cam engaging end part 53 is engaged with the rotating shaft 55 (a non-cut portion where the eccentric cam 56 is not formed) as shown in FIG. 3, the cam engaging end part 53 is pressed downward (or an oblique right and lower direction), and the upper portion of the main part 51 is separated downward from the inner circumferential face of the fixing belt 21. As the result, the contact force between the main part 51 and the inner circumferential face of the fixing belt 21 is lowered. The main part 51 except for the upper portion is kept contacting the inner circumferential face of the fixing belt 21.

A fixing operation of the fixing device 6 having the above described configuration will be described. When a plain paper is passed through the pressing area N, as shown in FIG. 2, the pressing area N is kept in the pressure increased condition. The rotating shaft 55 of the contact force changing part 26 is rotated such that the cam engaging end part 53 of the belt guide 25 is engaged with the eccentric cam 56, and the belt guide 25 is kept contacting the fixing belt 21 with the increased pressure.

When the color printer 1 is turned off, when a paper jammed in the fixing device 6 is removed or when a thick sheet such as an envelope is passed, the pressure of the pressing area N is decreased to a lower pressure than the pressure at the plain paper passing. By decreasing the pressure of the pressing area N, it becomes possible to prevent occurrence of a C-set phenomenon of the pressing roller 22 (a permanent recess generated on the pressing roller 22 by leaving the pressing roller 22 under the pressure increased condition for a long period) when the color printer 1 is turned off. In addition, it becomes possible to make the removing work for the jammed paper easy when the jammed paper is removed. Furthermore, it becomes possible to prevent the sheet from being wrinkled when the thick sheet such as an envelope is passed.

Because a temperature spot is formed on the fixing belt 21 along the circumferential direction when the fixing belt 21 is heated without rotating, it is required to heat the fixing belt 21 with rotating. In addition, after the color printer 1 is turned on, or after the removing work for the jammed sheet is finished, in order to heat the fixing belt 21 quickly, it is required to heat the fixing belt 21 in the state where the pressing area N is kept in the pressure decreased condition. In addition, when the envelope is passed, it is required to heat the fixing belt 21 in the state where the pressing area N is kept in the pressure decreased condition in order to prevent the sheet from being wrinkled.

In order to decrease the pressure of the pressing area N, as described above, in the pressure changing part 23, the eccentric cam 37 is rotated such that the pressure decreasing face 40*b* comes into contact with the cam follower 39. On the other hand, when the pressure of the pressing area N is decreased, the conveying force of the sheet N passing through the pressing area N may be lowered.

Then, when the pressure of the pressure area N is decreased, the contact force changing part 26 moves the belt guide 25 in the direction away from the fixing belt 21 so as to lower the contact force between the belt guide 25 and the fixing belt 21. That is, as described above, the rotating shaft 55 is rotated such that the cam engaging end part 53 is engaged with the rotating shaft 55 (the non-cut portion where the eccentric cam 56 is not formed). Thereby, the cam engaging end part 53 is pressed downward (or the oblique right and lower direction), and the upper portion of the main part 51 is separated downward from the inner circumferential face of the fixing belt 21 to lower the sliding load of the fixing belt 21 with respect to the belt guide 25. Accordingly, if the conveying force of the sheet S passing through the pressing area N is lowered, it becomes possible to prevent the slipping of the fixing belt 21 so that the sheet can be conveyed stably.

The pressure changing part 23 and the contact force changing part 26 are electrically connected to a control part (not shown). When the pressure changing part 23 changes the pressure of the pressing area N, the control part controls the contact force changing part 26 so as to change the contact force between the belt guide 25 and the fixing belt 21 depending on the changed pressure.

As described above, in the fixing device 6 according to the present disclosure, when the pressure of the pressing area N is decreased, the contact force changing part 26 makes the contact force between the belt guide 25 and the fixing belt 21 lower so as to lower the sliding load. Thereby, if the pressure of the pressing area N is decreased and the conveying force of the sheet is lowered, it becomes possible to rotate the fixing belt 21 without slipping. Accordingly, the sheet can be conveyed suitably to prevent the heating failure and the conveying failure.

In addition, when the contact force between the belt guide 25 and the fixing belt 21 is lowered, although the belt guide 25 is separated from the fixing belt 21 at the downstream side of the pressing area N in the rotating direction of the fixing belt 21, the belt guide 25 is kept contacting the fixing belt 21 at the upstream side of the pressing area N. Accordingly, it becomes possible to stabilize the rotating orbit of the fixing belt 21. Especially, because the rotating orbit of the fixing belt 21 is kept stable at the side from which the sheet is introduced, the sheet can be introduced to the pressing area N smoothly.

Additionally, because the contact force changing part 26 is constructed by the rotating shaft 55 having the eccentric cam 56, the contact force changing part 26 can have a simple structure.

In the present embodiment, when the pressure of the pressing area N is decreased to a lower pressure than the pressure at the plain paper passing, the contact force changing part 26 makes the contact force between the belt guide 25 and the fixing belt 21 lower. However, when the pressure of the pressing area N is decreased to two or more lower pressures, the contact force changing part 26 may change the contact force between the belt guide 25 and the fixing belt 21 in two or more conditions depending on the pressure of the pressing area N.

In the present embodiment, the contact force changing part 26 adjusts the contact force between the belt guide 25 and the fixing belt 21 depending on the pressure of the pressing area N. On the other hand, in another embodiment, the contact force changing part 26 may adjust the contact force between the belt guide 25 and the fixing belt 21 as needed other than the case where the pressure of the pressing area N is changed.

The embodiment of the present disclosure was described in a case of applying the configuration of the present disclosure to the color printer 1. On the other hand, in another embodiment, the configuration of the disclosure may be applied to another image forming apparatus, such as a copying machine, a facsimile or a multifunction peripheral, except for the color printer 1.

The invention claimed is:

1. A fixing device comprising:

a flexible rotating fixing belt;

a pressing member which forms a pressing area with the fixing belt;

a heating part heating the fixing belt from an outside of the fixing belt;

a pressing pad disposed to face the pressing roller and configured to contact an inner circumferential face of the fixing belt;

a guide member disposed to face the heating part at an opposite side to the pressing area and configured to come into contact with the inner circumferential face of the fixing belt to support the fixing belt so as to face the heating part;

a contact force changing part which moves the guide member in directions close to or away from the fixing belt to change a contact force between the guide member and the fixing belt; and a pressure changing part which moves the pressing member in directions close to or away from the fixing belt to change the pressure of the pressing area, wherein when the pressure changing part decreases the pressure of the pressing area to a lower pressure than a pressure at a plain paper passing, the contact force changing part moves the guide member in the direction away from the fixing belt so as to lower the contact force between the guide member and the fixing belt and lowers a sliding load of the fixing belt with respect to the guide member.

2. The fixing device according to claim 1, wherein the contact force changing part keeps the guide member contacting the fixing belt at an upstream side of the pressing area in a rotating direction of the fixing belt and moves the guide member in directions close to or away from the fixing belt at a downstream side of the pressing area in the rotating direction.

3. The fixing device according to claim 1, wherein the guide member includes a main part having an arc-shaped cross section along the inner circumferential face of the fixing belt, a supporting end part provided at one end of the main part in a circumferential direction of the fixing belt and an engaging end part provided at the other end of the main part in the circumferential direction, and is supported such that the main body is elastically biased to the direction close to the fixing belt around the supporting end part.

4. The fixing device according to claim 3, wherein the contact force changing part includes an eccentric cam rotating around a rotating shaft parallel with a rotation axis of the fixing belt, and the engaging end part follows the rotating eccentric cam, the main part moves in the directions close to or away from the fixing belt around the supporting end part.

5. The fixing device according to claim 4, wherein the eccentric cam is formed by partially cutting a center portion of the rotating shaft along a circumferential direction of the rotating shaft.

6. An image forming apparatus comprising;

an image forming part forming a toner image on a sheet; and the fixing device according to claim 1, fixing the toner image on the sheet.

7. The fixing device according to claim 1, wherein the pressure changing part includes:

a supporting arm supporting the pressing roller rotatably and rotatable around a rotating shaft in directions in which the pressing roller is close to the fixing belt or away from the fixing belt;

a pressing arm rotatable around the rotating shaft;

a spring disposed between the supporting arm and the pressing arm; and an eccentric cam capable of coming into contact with the pressing arm, wherein by rotating the eccentric cam, the pressing arm is turned around the rotating shaft, and then the supporting arm is turned around the rotating shaft so that the pressing roller is close to or separated away from the fixing roller.

* * * * *